US010609467B1

(12) United States Patent
Cai et al.

(10) Patent No.: US 10,609,467 B1
(45) Date of Patent: Mar. 31, 2020

(54) HEAD WEARABLE EQUIPMENT WITH ADJUSTABLE BONE-CONDUCTIVE ACOUSTIC DEVICE

(71) Applicant: NEXTVPU (SHANGHAI) CO., LTD., Shanghai (CN)

(72) Inventors: Haijiao Cai, Shanghai (CN); Xinpeng Feng, Shanghai (CN); Ji Zhou, Shanghai (CN)

(73) Assignee: NEXTVPU (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/529,699

(22) Filed: Aug. 1, 2019

Related U.S. Application Data

(63) Continuation of application No. PCT/CN2019/082237, filed on Apr. 11, 2019.

(30) Foreign Application Priority Data

Sep. 21, 2018 (CN) ..... 2018 1 1105366

(51) Int. Cl.
*H04R 1/00* (2006.01)
*H04R 1/10* (2006.01)

(52) U.S. Cl.
CPC ..... *H04R 1/1066* (2013.01); *H04R 1/105* (2013.01); *H04R 2460/13* (2013.01)

(58) Field of Classification Search
CPC ..... H04R 1/10; H04R 1/1008; H04R 1/1016; H04R 1/1041; H04R 2225/61; H04R 5/033; H04R 25/65
See application file for complete search history.

(56) References Cited

U.S. PATENT DOCUMENTS

2007/0008484 A1* 1/2007 Jannard ..... G02C 3/003 351/41
2008/0273163 A1* 11/2008 Sasaki ..... G02C 11/06 351/113
2011/0051960 A1* 3/2011 Robuchon ..... H04R 1/1066 381/151
2012/0082333 A1* 4/2012 Amae ..... H04M 1/05 381/375
2012/0105740 A1* 5/2012 Jannard ..... G02C 9/04 348/794
2014/0185837 A1* 7/2014 Kunimoto ..... H04R 1/1075 381/151

(Continued)

FOREIGN PATENT DOCUMENTS

CN 205179304 U 4/2016
CN 106785344 A 5/2017

(Continued)

*Primary Examiner* — Matthew A Eason
(74) *Attorney, Agent, or Firm* — Seed IP Law Group LLP

(57) ABSTRACT

The present disclosure provides a head wearable equipment with an adjustable bone-conductive acoustic device movably coupled to the head wearable equipment and the moving manner at least includes rotation. A technical effect of adaptive adjustment according to the wearer's head form or facial shape can be realized via the structural arrangement of the adjustable bone-conductive acoustic device, with the characteristics of a large adjustable range, strong adaptability, high comfortability and a wide range of application.

10 Claims, 6 Drawing Sheets

(56) References Cited

U.S. PATENT DOCUMENTS

| | | | | |
|---|---|---|---|---|
| 2014/0363003 | A1* | 12/2014 | Kupershmidt | H04R 29/00 381/58 |
| 2016/0060926 | A1* | 3/2016 | Kim | G06F 1/163 361/679.01 |
| 2017/0127167 | A1* | 5/2017 | Zheng | H04R 1/1008 |
| 2018/0063627 | A1* | 3/2018 | Kubba | H04R 1/46 |

FOREIGN PATENT DOCUMENTS

| | | | |
|---|---|---|---|
| CN | 206684411 | U | 11/2017 |
| CN | 206807709 | U | 12/2017 |
| CN | 107797308 | A | 3/2018 |
| CN | 207184774 | U | 4/2018 |
| EP | 3 329 792 | A1 | 6/2018 |
| JP | 2007-72015 | A | 3/2007 |
| JP | 2007-312050 | A | 11/2007 |
| JP | 2008-118401 | A | 5/2008 |
| JP | 2009-69219 | A | 4/2009 |
| JP | 3202255 | U | 1/2016 |
| JP | 2016-36094 | U | 3/2016 |
| KR | 10-1853248 | B1 | 4/2018 |
| KR | 10-0865959 | B1 | 10/2018 |
| WO | 2007/069784 | A1 | 6/2007 |
| WO | 2014/097744 | A1 | 6/2014 |

* cited by examiner

HEAD WEARABLE EQUIPMENT WITH ADJUSTABLE BONE-CONDUCTIVE ACOUSTIC DEVICE

RELATED APPLICATIONS

This application is a continuation of and claims priority from PCT Application No. PCT/CN2019/082237 filed on Apr. 11, 2019, which claims priority to Chinese Application No. CN201811105366.X filed on Sep. 21, 2018. This application also claims priority to the Chinese Application No. CN201811105366.X filed on Sep. 21, 2018. The contents of the PCT Application No. PCT/CN2019/082237 and the Chinese Application No. CN201811105366.X are incorporated herein by reference at their entirety.

TECHNICAL FIELD

The present disclosure relates to the field of wearable equipment, and more particularly to a head wearable equipment with an adjustable bone-conductive acoustic device.

BACKGROUND

Technical Field

The present disclosure relates to the field of wearable equipment, and more particularly to a head wearable equipment with an adjustable bone-conductive acoustic device.

Description of the Related Art

Bone-conduction is one kind of sound conduction, which converts the sound into mechanical vibration of different frequencies, and transmits sound waves through human skull, bone labyrinth, inner ear lymphatic transmission, auger, auditory nerve, and auditory center. Compared to the classical sound transmission method that produces sound waves through the diaphragm, bone-conduction cancels many steps of sound wave transmission, enabling clear sound reproduction in noisy environments, and sound waves will not influence other people on account of spreading in the air. The original acoustic device utilizing bone-conduction mainly includes a bone-conductive earphone and a bone-conductive microphone.

Taking the bone-conductive earphone as example, the main structure of most of the current bone-conductive earphones includes two earphone portions and a rear coupling rod connecting the earphone portions (as disclosed in US2014/0185837A1 or CN205179304U), and usually the earphone portions are fixed. The adaption of the bone-conductive earphone to the wearer's head form or facial form is adjusted mainly by adjusting the rear coupling rod. When the bone-conductive earphone is integrated into other types of head wearable equipment (such as eyeglass, helmets, etc.), other methods are needed to adjust the wearing adaptability of the bone-conductive earphone since there is no component of rear coupling rod any more.

Technology of placing a bone-conductive earphone on eyeglasses has been known in the prior art. As a common solution for solving the problem of adapting the bone-conductive earphone to the wearer's head form or facial form, the connecting component of the earphone and the wearing device or a component of the wearing device (such as a leg of eyeglasses) is made of resilient material. For example, in CN207184774U, the adaptability of a bone-conductive earphone disposed on the eyeglass is improved by providing a housing including the bone-conductive earphone body and a corresponding clamping portion, and using an elastic material such as rubber, silicone or the like to produce the clamping portion. In CN206684411U, the adaptability of the bone-conductive earphones to different facial forms is realized mainly through elasticity by encapsulating the outer layer of the leg of eyeglasses with silicone. However, the disadvantages of this solution are apparent, including a small adjustable range, severe discomfort in clamping, and decreased adaptability due to aging of the elastic component after prolonged use.

CN107797308A discloses sunglasses that can adjust the position of a conduction earphone, wherein the bone-conductive earphone is coupled to the leg of the sunglasses through a coupling structure comprising a connecting plate which is fixed to the bone-conductive earphone and has a guide hole, a connecting groove which is located on the leg and into which the connecting plate extends, and a protruding rod which is located in the connecting groove and extends into the guiding hole, and the protruding rod is located in different positions of the guide hole by pushing or pulling the bone-conductive earphone to adjust the length of the bone-conductive earphone extending out of the connecting groove, thereby adjusting the bone-conductive earphone to fit different parts of the user's cheek. However, the structure only allows the bone-conductive earphone to translate in the direction of the leg of the eyeglass, and cannot move in other directions. That is, only the length of the bone-conductive earphone extending the leg of the eyeglass can be adjusted. The adjustment range is very small. Meanwhile, the adjustment structure such as guiding rod, etc., is easy to expose, which is not beautiful. In addition, due to the groove and push-pull guiding rod structure, it is easy to pinch the user's hair, resulting in discomfort.

BRIEF SUMMARY

Based on the above, there is a need to provide a head mounted device of a bone-conductive acoustic device that has a large adjustable range, strong adaptability and high comfortability.

Based on this need, the present disclosure provides the following equipment: a head mounted bone-conductive acoustic device comprising a head wearable equipment and a bone-conductive acoustic member, wherein the bone-conductive acoustic member is one of or a combination of several of a bone-conductive earphone, a speaker or a microphone, and wherein the bone-conductive acoustic member is at least rotatably coupled to the head wearable equipment by a coupling structure.

According to an aspect of the present disclosure, a head wearable equipment in the head mounted bone-conductive acoustic device of the present disclosure includes, but is not limited to, eyeglasses, a mask, a helmet, a cap, a head mounted display, a head mounted light, a virtual reality equipment, a head mounted fan, a head mounted gaming equipment, a head mounted medical equipment, a head mounted control device, and a head mounted intercommunication device. The eyeglasses include, but are not limited to, ordinary optical eyeglasses or smart eyeglasses having computing or communication function; the head mounted medical equipment includes, but is not limited to, a head mounted blood pressure measuring device; the head mounted control device includes, but is not limited to, a voice control device.

According to an aspect of the present disclosure, the bone-conductive acoustic member in the head mounted bone-conductive acoustic device of the present disclosure is a bone-conductive earphone or a bone-conductive microphone or a combination of both.

According to an aspect of the present disclosure, the head wearable equipment in the head mounted bone-conductive acoustic device of the present disclosure is eyeglasses, including ordinary optical eyeglasses or smart eyeglasses having computing function or communication function.

According to an aspect of the present disclosure, the eyeglasses include a leg to which the bone-conductive acoustic member is coupled by a rotation structure including a rotating shaft bracket and a connecting member, wherein the rotating shaft bracket is coupled to the leg and is provided with a hole. According to a preferred aspect of the present disclosure, the rotating shaft bracket is fixedly coupled to the leg by snapping, riveting, screwing, spiral coupling, or integral molding.

According to an aspect of the present disclosure, the bone-conductive acoustic member at least includes two housings, respectively a first housing and a second housing; the connecting member of the rotation structure includes a rotating shaft, which is coupled to the inner side of the first housing at one end and is coupled to the inner side of the second housing after passing through the hole in the rotating shaft bracket; a gasket is arranged between the first or the second housing and the rotating shaft bracket to increase damping, and the gasket can increase the friction between the inner wall of the housing and the rotating shaft bracket, preventing the bone-conductive acoustic device from sliding freely on the rotating shaft, thereby locking the bone-conductive acoustic device to a specified position by friction. According to a preferred aspect of the present disclosure, the coupling manner of the rotating shaft to the inner side of the first housing is selected from one of the following first coupling manner or second coupling manner: the first coupling manner is configured as follows: the one end of the rotating shaft and the first housing are respectively provided with texturing structure at the portions where they are coupled, and the first housing is provided with a mounting groove, the texturing structure of the rotating shaft is engaged with the texturing structure of the first housing, and the rotating shaft is inserted in the mounting groove of the first housing, the texturing structures providing an engaging force to prevent slippage between the rotating shaft and the housing; the second coupling manner is configured as follows: one end of the rotating shaft is integrally formed on and coupled to the inner side of the first housing. According to a preferred aspect of the present disclosure, the above gasket includes a metal gasket, a silicone gasket, and a rubber gasket.

According to an aspect of the present disclosure, the rotating shaft is coupled to the inner side of the second housing after passing through the hole in the rotating shaft bracket, and the rotating shaft is coupled to the second housing by a fixing member. According to a preferred aspect of the present disclosure, the fixing member includes a screw, a bolt, and a connector with an extending end, and the coupling includes inserting coupling, snapping coupling, plugging-in coupling, threaded coupling, welding, riveting, screw fixing; a gasket is optionally provided between the fixing member and the second housing.

According to a preferred embodiment of the present disclosure, the present disclosure provides eyeglasses having a rotatable bone-conductive earphone which comprises eyeglasses, a bone-conductive earphone, and a rotation structure connecting both, wherein the eyeglasses comprises a leg, the bone-conductive earphone comprises two housings, respectively a first housing and a second housing, the rotation structure comprises a rotating shaft bracket and a connecting member, the rotation shaft bracket is provided with a hole, and the connecting member comprises a rotating shaft and a fixing member; wherein one end of the rotating shaft and the first housing of the bone-conductive earphone are provided with a texturing structure, and a mounting groove for providing the texturing structure is formed in the first housing; wherein, the rotating shaft bracket is coupled to the leg by snapping, riveting, screwing, spiral coupling, or integrally molding; the rotating shaft and the first housing of the bone-conductive earphone are coupled with each other by the texturing structures, and then the texturing structures are inserted in the mounting groove of the first housing, and after passing through the hole in the rotating shaft bracket the rotating shaft is coupled to the second housing by the fixing member, and a gasket is arranged between the first or the second housing and the rotating shaft bracket to increase damping. The gasket is a metal gasket, a silicone gasket or a rubber gasket.

Advantageous effects of the present disclosure include: a solution for a rotatable bone-conductive earphone that can be adaptively adjusted according to a wearer's head form or facial form is provided, wherein the bone-conductive acoustic device can be rotatably moved relative to the rotatable bone-conductive headphone in accordance with the head form or facial form of different wearers, so that the solution has a large adjustable range, strong adaptability, high comfort and a wide application range.

Figure 1:
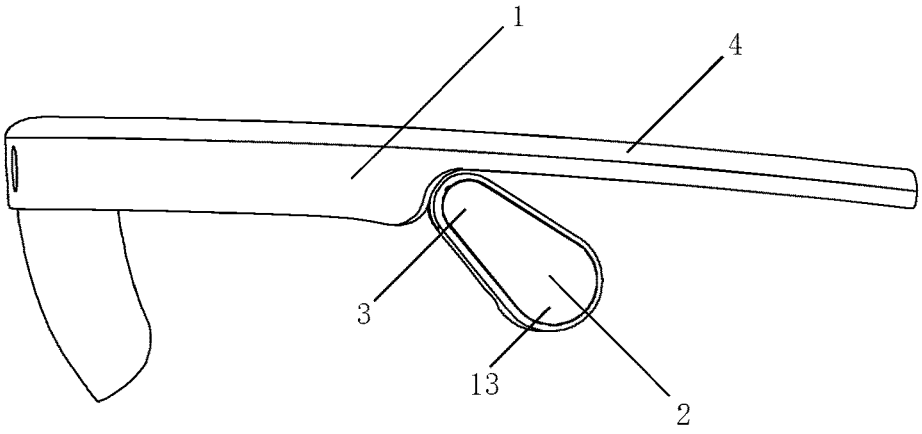
FIG. 1 is a schematic view of the eyeglasses having a rotatable bone-conductive earphone according to an embodiment of the present disclosure.

Reference numbers in the drawings are: 1—head wearable equipment; 2—bone-conductive acoustic member; 3—first end, 4—frame, 5—head, 6—first rotation position, 7—second rotation position, 8—first spot, 9—second spot, 10—rotating shaft bracket, 11—mounting hole with internal thread, 12—hole, 13—second end, 21—second housing of bone-conductive earphone, 22—first housing of bone-conductive earphone, 221—mounting groove, 31—rotating shaft, 32—screw, 40—leg, 41—mounting hole, and 50—gasket.

DETAILED DESCRIPTION

The present disclosure will be further described in detail below with reference to the accompanying drawings.

FIG. 1 is a head mounted bone-conductive acoustic device including a head wearable equipment 1 and a bone-conductive acoustic member 2. The head wearable equipment 1 includes a frame 4. The head wearable equipment 1 may include, but is not limited to, eyeglasses, a mask, a helmet, a cap, a head mounted display, a head mounted light, a virtual reality equipment, a head mounted fan, a head mounted gaming equipment, a head mounted medical equipment, a head mounted control device, and a head mounted intercommunication device. The head mounted medical equipment includes, but is not limited to, a head mounted blood pressure measuring device. The head mounted control device includes, but is not limited to, a voice control device.

Eyeglasses are used in FIG. 1 as an example of the head wearable equipment 1 for illustrative and/or descriptive purposes. The eyeglasses 1 include, but are not limited to, ordinary optical eyeglasses or smart eyeglasses having computing or communication function.

The bone-conductive acoustic member 2 is a bone-conductive earphone, a bone-conductive microphone, a bone-conductive speaker or any combinations thereof. In the disclosure, a bone-conductive earphone is used as an illustrative example of the bone-conductive acoustic member 2 for illustrative and/or descriptive purposes.

FIG. 1 is a side view of the eyeglasses 1, and FIG. 2 is a side view of the eyeglasses 1 being worn by a human. As described herein, the eyeglasses 1 include a leg 40 (FIG. 3) as part of the frame 4. The bone-conductive acoustic member 2 is coupled to the frame 4 of the eyeglasses or specifically the leg 40 through a rotation structure including a rotating shaft bracket and a connecting member, which are described herein in detail. As such, the bone-conductive acoustic member is configured to rotate with respect to the frame 4, specifically leg 40, between a first rotation position 6 adjacent to a first spot 8 on a head 5 of a human wearing the head wearable equipment 1 and a second rotation position 7 adjacent to a second spot 9 on the head 5 of the human wearing the head wearable equipment.

For example, the bone-conductive acoustic member 2 includes a first end 3 and a second end 13. The first end 3 is rotatably pivoted onto the frame 4 and the second end 13 is configured to rotate between the first rotation position, where the second end 13 is more proximal to the frame 4 and a second rotation position, where the second end 13 is more distal to the frame 4.

Figure 2A:
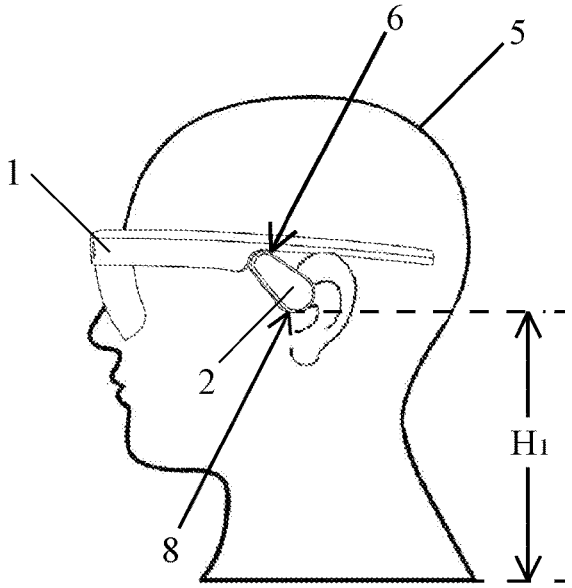
FIGS. 2A and 2B are schematic views of the eyeglasses having the rotatable bone-conductive earphone according to an embodiment of the present disclosure after the bone-conductive earphone is retracted (FIG. 2A) and rotates (FIG. 2B)
Figure 2B:
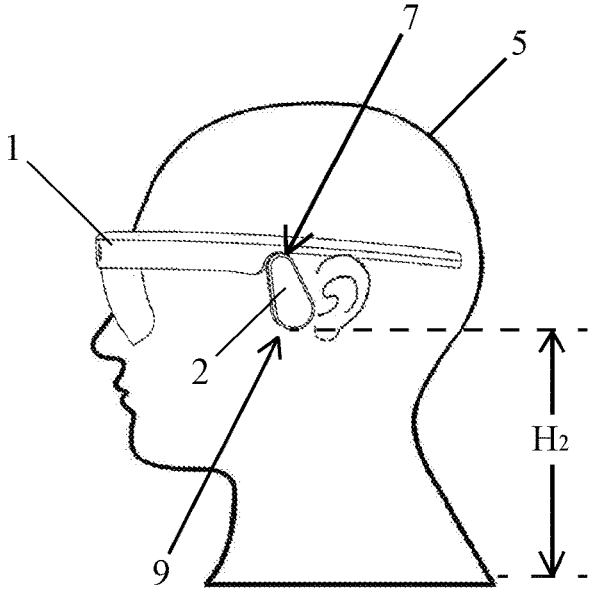

FIG. 2A shows the bone-conductive acoustic member 2 being rotated to the first rotation position 6, also referred to as a retracted state. FIG. 2B shows the bone-conductive acoustic member being rotated to the second rotation position 7, also referred to as a rotated-down state. At the first rotation position 6, the bone-conductive acoustic member 2 is adjacent to or interfaces with a first spot 8 on the head 5 of the human wearing the eyeglasses 1. At the second rotation position 7, the bone-conductive acoustic member 2 is adjacent to or interfaces with a second spot 9 on the head 5 of the human wearing the eyeglasses 1. The first spot 8 and the second spot 9 are different spots or locations on the head 5 of the human. For example, the first spot 8 is higher on the head 5, e.g., having a larger height H1, than the second spot 9, e.g., having a smaller height H2 in a vertical direction with respect to the head 5. By enabling the bone-conductive acoustic member 2 to rotate with respect to the frame of the eyeglasses 1, it is easier for the human to position bone-conductive acoustic member 2 to a suitable bone location on his/her head 5 to achieve the full benefits or performance of the bone-conductive acoustic member 2. For example, when the bone-conductive acoustic member 2 rotates to different positions between positions 6, 7, the frame 4 of the eyeglasses 1 may maintain a same wearing position with respect to the head 5 of the human.

The eyeglasses 1 include lenses, a frame, and a leg. The structures of the lenses and frame are structures of the conventional eyeglasses in the art. According to the different types of eyeglasses, those skilled in the art can select lenses or frame of suitable structures. For example, the eyeglasses according to the present embodiment are ordinary eyeglasses or smart eyeglasses, and those skilled in the art can select corresponding structures of lenses and frame.

Figure 3A:
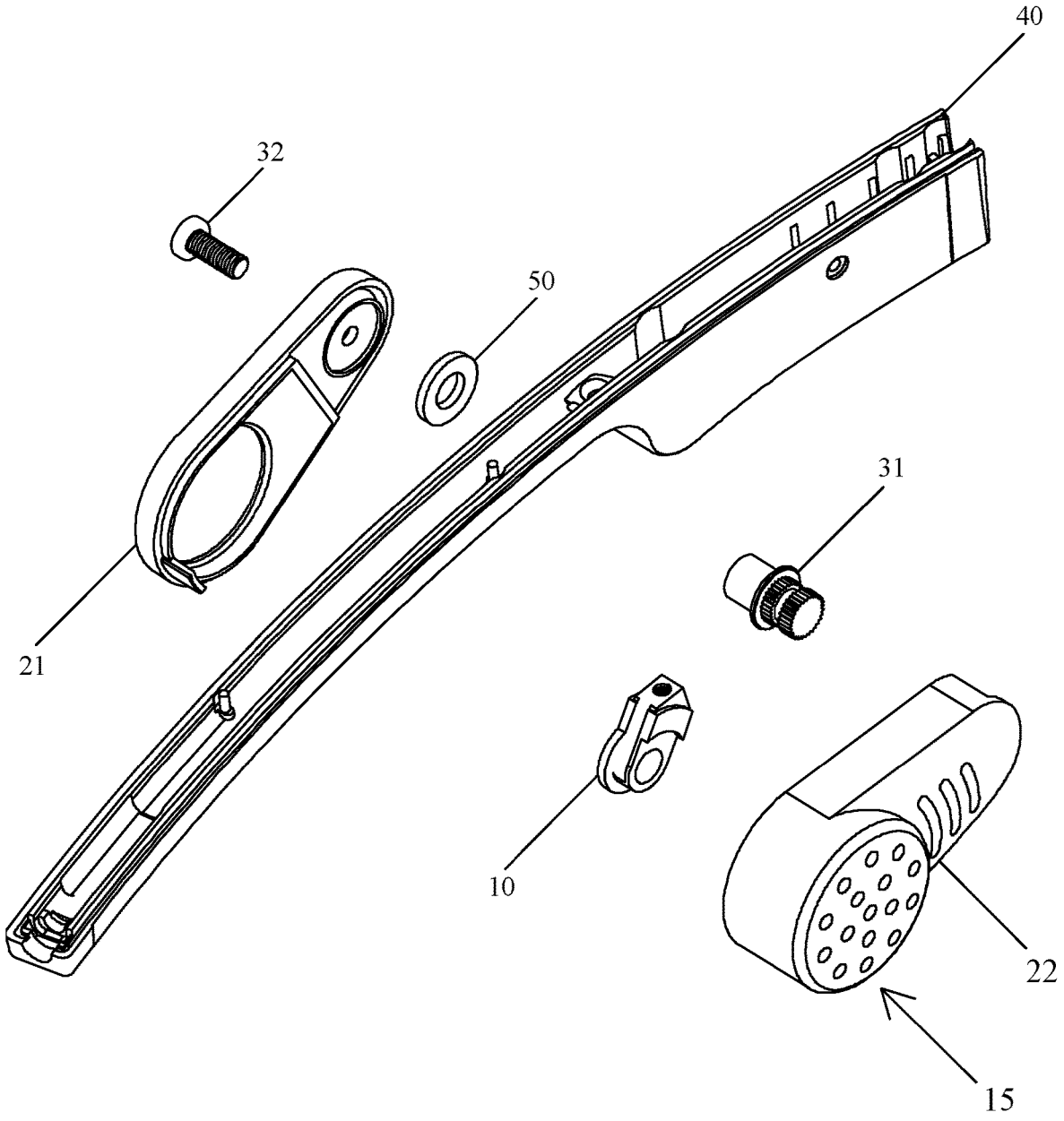
FIGS. 3A and 3B are respectively a schematic view of the components of the eyeglasses having the rotatable bone-conductive earphone according to an embodiment of the present disclosure (FIG. 3A) and a schematic view after the components are assembled (FIG. 3B)
Figure 3B:
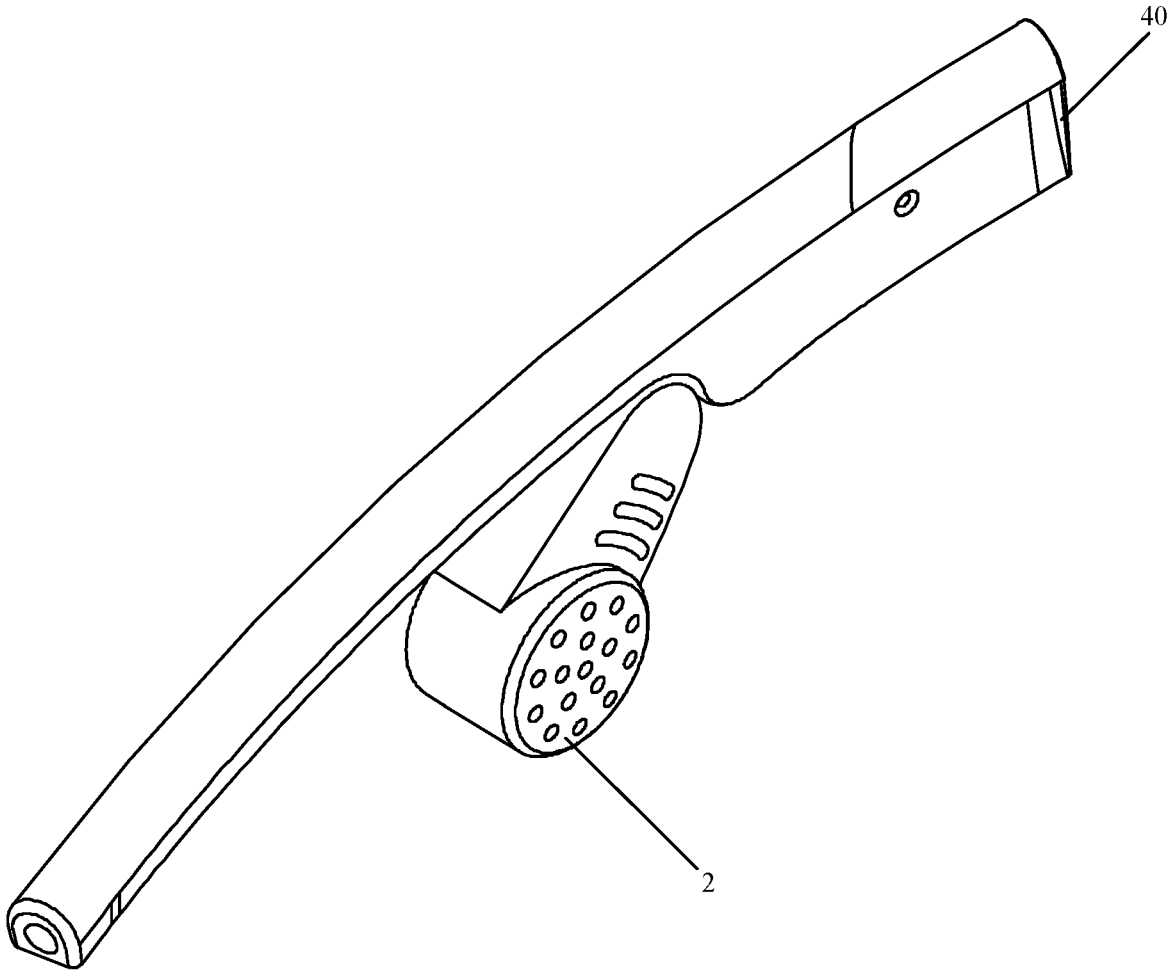

As shown in FIGS. 3A and 3B, the bone-conductive earphone 2 described above is rotatably coupled to the leg 40 of eyeglasses by a connecting structure which comprises a rotating shaft bracket 10 and a connecting member. The bone-conductive earphone comprises a first housing 22 and a second housing 21 of bone-conductive earphone, and the connecting member comprises a rotating shaft 31 and a screw 32 (also referred to as fixing member). In an embodiment, the electronic components 15 of the bone-conductive earphone 2 are hosted at least in the first housing 22 that is arranged to interface with the head 5 of the human wearing the eyeglasses 1.

Figure 4:
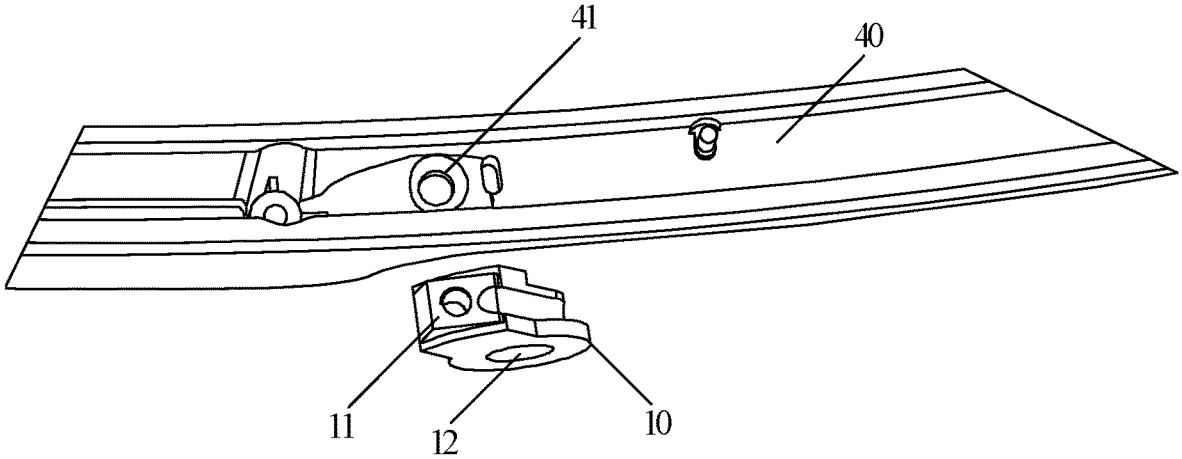
FIG. 4 is a schematic view showing a connecting structure of a leg and a rotating shaft bracket of the eyeglasses having the rotatable bone-conductive earphone according to an embodiment of the present disclosure.

As shown in FIG. 4, the leg 40 of eyeglasses has a coupling point to the rotating shaft bracket 10. The coupling between the rotating shaft bracket 10 and the leg 40 is configured as conventional coupling in the art, such as screwing, snapping coupling, plugging-in coupling, inserting coupling and the like. For example, when screwing is used, the coupling point is located at a mounting hole 41. A mounting hole 11 having an internal thread is provided in the rotating shaft bracket. The screw is screwed into the mounting hole 11 through the mounting hole 41, thereby fixing the rotating shaft bracket 10 onto the leg 40. In addition, the rotating shaft bracket 10 is also provided with a hole 12 through which the rotating shaft 31 can pass.

Figure 5A:
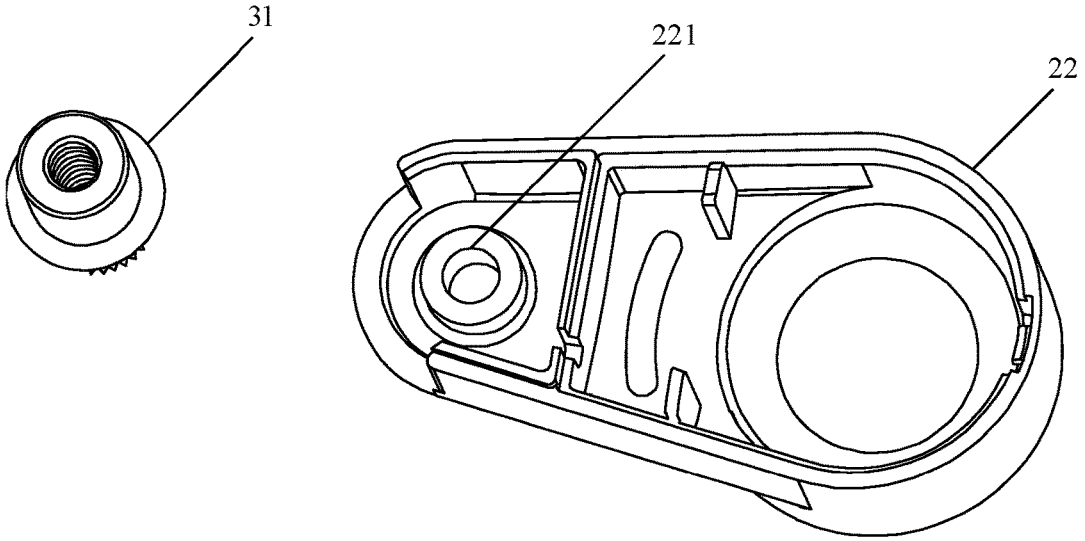
FIGS. 5A and 5B are schematic views of a rotating shaft of the eyeglasses having a rotatable bone-conductive earphone and a housing of the bone-conductive earphone according to an embodiment of the present disclosure, wherein there is a gasket (FIG. 5B) or there is no gasket (FIG. 5A) provided between the rotating shaft and the housing of the bone-conductive earphone.
Figure 5B:
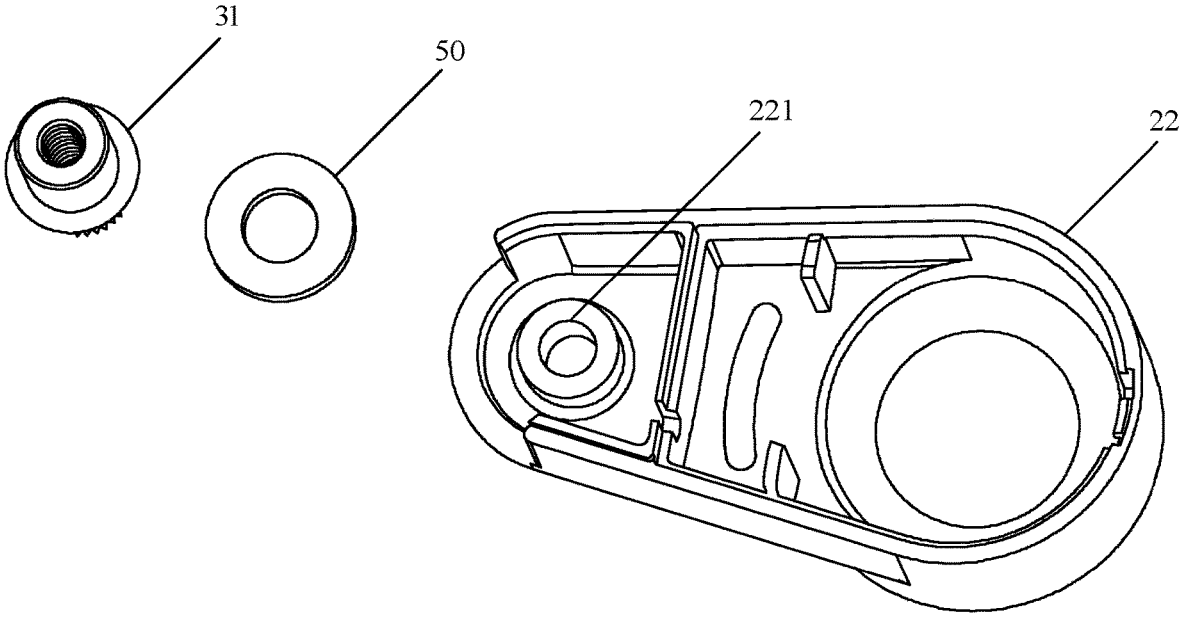

As shown in FIGS. 5A and 5B, the inner side of the first housing 22 of bone-conductive earphone is provided at one end with a mounting groove 221 having a texturing structure. The rotating shaft 31 is also provided with a texturing structure at one end, and is inserted in the mounting groove 221 to connect the rotating shaft 31 with the first housing 22 of bone-conductive earphone. By the engaging force provided by the texturing structure, slippage between the rotating shaft 31 and the first housing 22 can be avoided. The texturing structure can be formed as follows: placing the rotating shaft in a mold for injecting the housing; forming the housing by means of injection molding, wherein after the injection molding, a housing to which the rotating shaft is coupled is formed, and wherein in the process of injection molding, a structure engaged with the textures of the rotating shaft end is correspondingly formed in the inner wall of the mounting groove of the housing.

Figure 6:
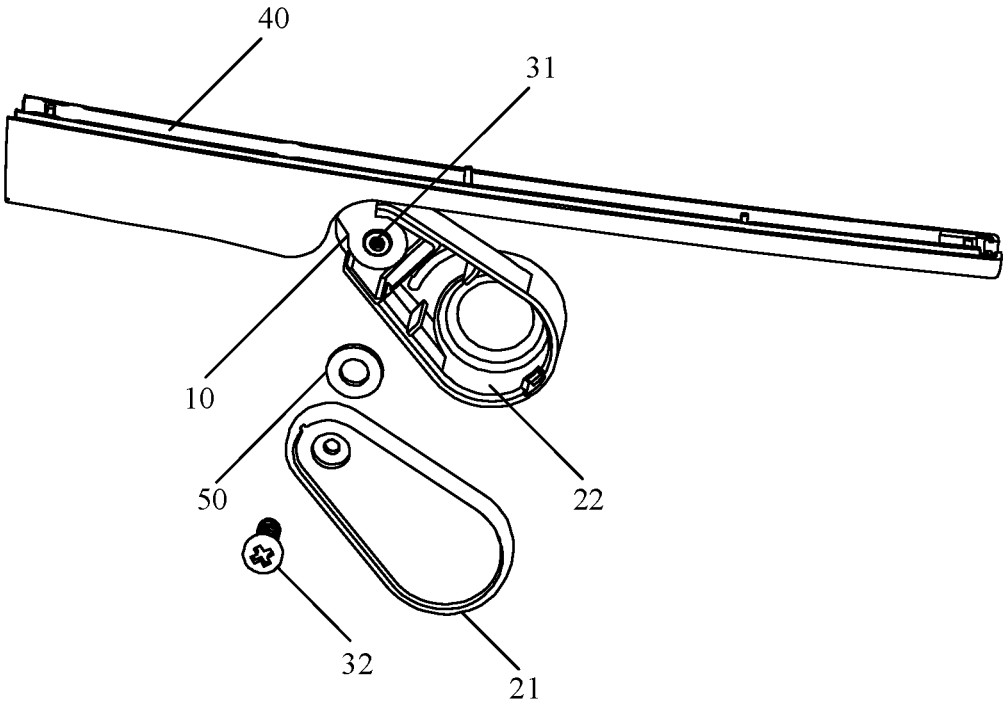
FIG. 6 is a schematic view showing the coupling of the leg of the eyeglasses having a rotatable bone-conductive earphone and the bone-conductive earphone according to an embodiment of the present disclosure.

After the rotating shaft bracket 10 and the leg 40 are coupled, and the rotating shaft 31 and the first housing 22 of bone-conductive earphone are coupled, as shown in FIG. 6, the other end of the rotating shaft 31 is passed through the hole 12 in the shaft bracket 10; on the other side, a screw 32 passes through the hole in the second housing 21 from the outer side of the second housing 21 to the inner side of the second housing 21 and is screwed into the rotating shaft 31 having internal thread, so that the second housing 21 of the bone-conductive earphone could be coupled to the rotating shaft bracket. A gasket may be provided between the screw 32 and the second housing 21 to avoid causing wear to the housing during the screwing-in of the screw.

A gasket 50 is further disposed between the first housing 22 or the second housing 21 of the bone-conductive earphone and the rotating shaft bracket 10, and the gasket may be a metal gasket, a silicone gasket, or a rubber gasket. For example, the gasket 50 may be disposed between the second housing 21 and the rotating shaft bracket 10 (as shown in FIG. 3A); for example, the gasket 50 is disposed between the first housing 22 and the rotating shaft bracket 10, and specifically, may be disposed between the rotating shaft 31 and the first housing 22 (as shown in FIG. 5B), and alternatively, may be disposed between the rotating shaft 31 and the rotating shaft bracket 10. The gasket 50 can increase the friction between the inner wall of the housing and the rotating shaft bracket, that is, increase the damping, thereby preventing the bone-conductive earphone from sliding freely on the rotating shaft. When an adjustment by means of rotation is needed, the rotation is possible only when an external force (such as pushing by hand) is applied. In this way, the bone-conductive earphone is locked in a designated position.

In an alternative or additional embodiment, it provides a pair of eyeglasses with a bone sensing earphone, which has a structure substantially identical to the eyeglass of the first embodiment. The difference only lies in the coupling between the rotating shaft 31 and the first housing 22. The texturing structure in the first embodiment is replaced by an integrally formed coupling between the rotating shaft 31 and the first housing 22, which will not slide relative to each other. This kind of coupling can be simultaneously formed by means of injection molding when the first housing 22 is injection molded.

The above embodiments are merely illustrative, but not intended to limit the technical solutions of the present disclosure. Although the present disclosure has been described in detail with reference to the foregoing embodiments, those skilled in the art should understand that the technical solutions described in the foregoing embodiments may be modified, or some of the technical features may be equivalently replaced. These modifications or replacements do not deviate the essence of the respective technical solutions from the spirit and scope of the technical solutions of the embodiments of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet including but not limited to Chinese application No. 201811105366.X and Chinese application No. 201821548188.3, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A head mounted bone-conductive acoustic device comprising:

a head wearable equipment including a frame; and a bone-conductive acoustic member at least rotatably coupled to the head wearable equipment through a coupling assembly of the bone-conductive acoustic member, the bone-conductive acoustic member configured to rotate with respect to the frame between a first rotation position adjacent to a first spot on a head of a human wearing the head wearable equipment and a second rotation position adjacent to a second spot on the head of the human wearing the head wearable equipment;

wherein the head wearable equipment is eyeglasses including a leg, wherein the bone-conductive acoustic member is configured to rotate with respect to the leg of the eyeglasses, wherein the bone-conductive acoustic member is coupled to the leg by the coupling assembly, the coupling assembly including a rotating shaft bracket and a connecting member, the rotating shaft bracket being coupled to the leg and having a hole, the connecting member being coupled to the rotating shaft bracket through the hole of the rotating shaft bracket, wherein the bone-conductive acoustic member includes a first housing and a second housing and wherein the connecting member includes a rotating shaft, the rotating shaft being coupled to an inner side of the first housing at a first end of the rotating shaft and being coupled to an inner side of the second housing at a second end of the rotating shaft after the rotating shaft passing through the hole in the rotating shaft bracket.

2. The head mounted bone-conductive acoustic device according to claim 1, wherein the bone-conductive acoustic member includes one or more of a bone-conductive earphone, a bone-conductive speaker or a bone-conductive microphone, wherein the eyeglasses include optical eyeglasses or smart eyeglasses having computing or communication functions embedded therein.

3. The head mounted bone-conductive acoustic device according to claim 1, wherein the rotating shaft bracket is fixedly coupled to the leg by means of snapping, riveting, screwing, spiral coupling, or integral molding.

4. The head mounted bone-conductive acoustic device according to claim 1, wherein one or more gasket is provided between the rotating shaft bracket and one or more of the first housing or the second housing.

5. The head mounted bone-conductive acoustic device according to claim 1, wherein the first end of the rotating shaft includes a first textured structure and the inner side of the first housing includes a mounting groove having a second textured structure, the first texturing structure of the first end of the rotating shaft being engaged with the second texturing structure of the mounting groove when the first end of rotating shaft is inserted into the mounting groove of the first housing.

6. The head mounted bone-conductive acoustic device according to claim 1, wherein the first end of the rotating shaft is integrally formed on the inner side of the first housing.

7. The head mounted bone-conductive acoustic device according to claim 1, wherein the rotating shaft is coupled to the second housing via a fixing member that passes through the second housing from outside thereof to inside thereof and is coupled to the rotating shaft, the fixing member including one or more of a screw, a bolt, or a connector with an expanding end.

8. The head mounted bone-conductive acoustic device according to claim 4, wherein the one or more gasket includes one or more of a metal gasket, a silicone gasket, and a rubber gasket.

9. The head mounted bone-conductive acoustic device according to claim 1, wherein the bone-conductive acoustic member is configured to rotate with respect to the frame with the frame staying substantially still with respect to the head of the human wearing the head wearable equipment.

10. The head mounted bone-conductive acoustic device according to claim 1, wherein the first spot on the head of a human wearing the head wearable equipment includes a different height from that of the second spot on the head of the human wearing the head wearable equipment in a vertical direction with respect to the head of the human.

* * * * *